US005419072A

United States Patent [19]

Moore et al.

[11] Patent Number: 5,419,072

[45] Date of Patent: May 30, 1995

[54] INTERNAL LASER SIGHT FOR WEAPONS

[76] Inventors: Larry Moore, 1598 Sierra Dr., P.O. Box 1861, Cottonwood, Ariz. 86326; Keith D. Halsey, 2824 Second St., Santa Monica, Calif. 90405

[21] Appl. No.: 8,679

[22] Filed: Jan. 25, 1993

Related U.S. Application Data

[63] Continuation-in-part of Ser. No. 4,451, Jan. 14, 1993, Pat. No. 5,392,550.

[51] Int. Cl.[6] ..... F41G 1/36

[52] U.S. Cl. ..... 42/103; 362/114

[58] Field of Search ..... 42/103; 362/110, 113, 362/114

[56] References Cited

U.S. PATENT DOCUMENTS

| | | | |
|---|---|---|---|
| 1,088,502 | 2/1914 | Williams | 362/114 |
| 1,215,171 | 2/1917 | Lewis | 362/110 |
| 2,017,585 | 10/1935 | Casey | 362/114 |
| 2,085,732 | 7/1937 | Barter et al. | 362/114 |
| 2,625,764 | 1/1953 | O'Brien et al. | 42/103 |
| 4,048,489 | 9/1977 | Giannetti | 42/103 |
| 4,168,588 | 9/1979 | Snyder | 42/103 |
| 4,542,447 | 9/1985 | Quakenbush | 362/183 |
| 4,627,183 | 12/1986 | Stuckman | 362/110 |
| 4,697,226 | 9/1987 | Verdin | 362/110 |
| 4,707,772 | 11/1987 | Jimenez et al | 362/110 |
| 4,777,754 | 10/1988 | Reynold, Jr. | 42/103 |
| 4,856,218 | 8/1989 | Reynolds, Jr. | 42/103 |
| 4,876,816 | 10/1989 | Triplett | 362/110 |
| 4,934,086 | 6/1990 | Houde-Walter | 42/103 |
| 4,939,863 | 7/1990 | Alexander et al. | 362/110 |
| 5,033,219 | 7/1991 | Johnson et al. | 42/103 |
| 5,092,071 | 3/1992 | Moore | 42/103 |

FOREIGN PATENT DOCUMENTS

| | | | |
|---|---|---|---|
| 1350575 | 4/1974 | United Kingdom | 42/103 |

*Primary Examiner*—Stephen M. Johnson

[57] ABSTRACT

An internally mounted laser beam gun sight suitable for use in automatic pistols is provided by replacing the conventional recoil spring guide rod with a hollow tube having substantially the same exterior shape and dimensions, but containing a laser beam generation module, batteries and an on/off switch within its hollow bore. In a preferred embodiment, the hollow tube has two portions which are movable with respect to each other. A first portion contains the batteries and a second portion contains the laser module. An insulated bushing containing a central electrical contact is located between the two portions. In the preferred embodiment, the central contact forms part of an internal electrical switch which is activated by relative motion of the first and second portions of the guide tube to turn the laser beam on and off.

20 Claims, 5 Drawing Sheets

INTERNAL LASER SIGHT FOR WEAPONS

This patent application is a Continuation-In-Part of application Ser. No. 08/004,451, filed Jan. 14, 1993, now U.S. Pat. No. 5,392,550 entitled "Internal Laser Sight for Weapons", to the same inventors.

FIELD OF THE INVENTION

The present invention concerns an internally mountable light beam sight for weapons and weapons containing such.

BACKGROUND OF THE INVENTION

It is well known in the art to utilize a light beam as a sighting aid for weapons. An illumination source is provided that projects a narrow beam of light in a direction parallel to the weapon boresight. When light beam and boresight are properly aligned, the bullet impact will be on or very close to the location of the light spot on the target. Light beam sighting aids are particularly useful at night when ordinary iron or telescopic sights are difficult to use because of low ambient and/or target illumination levels.

Lasers are the preferred means of generating light beams for sighting applications. They have comparatively high intensity, small spot size, and can be focused into a narrow beam with a very small divergence angle. Laser sights for weapons are well known in the art.

Heretofore, laser sights have been comparatively bulky and mounted outside of the weapon. With long guns, the bulk required for the laser sight is small compared to the size of the gun, that is, the additional volume and weight are a small percentage of the volume and weight of the gun itself. However, with hand guns, the typical externally mounted laser sight is a significant fraction of the volume of the gun itself and a gun with such a sight cannot generally be carded in a conventional holster. This is a great disadvantage, both because of the additional space required for the laser sight, and also because the externally mounted laser sight is comparatively easily damaged or knocked out of alignment. In police and military applications, there is a great premium on compact and extremely rugged weapons. Thus, there is a great desire to have a laser sight which is internal to the weapon so as to be protected from rough handling and which does not add to the bulk of the weapon.

It is known in the art to provide a light source within a hand gun such as a semi-automatic pistol. For example, a light emitting diode or a fiber-optic light conductor coupled to a light emitting diode, is mounted so as to project a light beam along the bore of a hollow recoil spring guide tube within the weapon. The recoil spring guide tube is located beneath the barrel. The direction and alignment of the light beam is determined by the direction and alignment of the guide tube. In pistols in which the recoil spring tube is parallel to the barrel, the light beam emanating from the recoil spring guide tube projects forward in the same general direction as the bullet travels. The battery and other electronics necessary to power the light emitting diode are mounted in the butt of the weapon.

However, such prior art approaches have several limitations, as for example, (i) no means is provided for adjusting the alignment of the light beam relative to the weapon boresight, (ii) substantial modification of the weapon may be needed to accommodate the battery, drive circuitry, and fiber-optic or electrical connections leading to the light emitter, and (iii) the light emitting diode mounted in the guide tube is poorly protected from shock and/or heat generated by firing the weapon. Modification of a weapon to accommodate such spaced-apart or remotely located components may require a skilled gunsmith. This limits the applicability of such an internal laser sight arrangement to those who can afford such modifications to their weapons, and to weapons which have sufficient un-used space within the butt or frame to accommodate the spaced-apart components. Thus, there continues to be a need for an improved, internally mounted laser sight for hand guns.

SUMMARY OF THE INVENTION

An advantage of the present invention is that it provides an internally mountable laser sight assembly that may be installed by persons of ordinary skill. A further advantage is that it is readily adaptable to a wide variety of weapons with few if any custom structural modifications of the weapon. A further advantage is that the trajectory of the emitted light beam may be adjusted to be aligned with the weapon boresight, thereby compensating for manufacturing tolerances in the weapon or the sight and for other anomalies, e.g., astigmatism in the light source or the light path. A still further advantage is that it may be used in weapons in which the recoil spring guide tube is not parallel to the barrel.

The foregoing and other advantages are provided by a light beam aimable weapon having a hollow tube mounted within the weapon and containing a light source. The tube conveniently serves as a recoil spring guide tube. In a preferred embodiment, the hollow tube has a first portion and a second portion. The first portion is coupled to the weapon and the second portion moves with respect to the first portion. A light beam generating module is mounted within the tube for projecting a light beam out of the tube. An energy storage means is provided and coupled to the light beam generating module for energizing the module. In a preferred embodiment, a switch means is provided for turning the light beam on and off when actuated by movement of the second portion of the tube relative to the first portion of the tube. The orientation of the light beam generating module is adjustable so that the light beam may be aligned with the weapon boresight.

It is desirable that the first and second portions of the tube are coaxially aligned and the second portion rotates with respect to the first portion around their common axis so as to make or break internal axially mounted electrical contacts coupling the energy storage means and the light beam generation module. It is further desirable that the light beam generation module is internal to the second portion and coupled thereto by a flexible mounting proximate a first end of the module and a transversely adjustable alignment means proximate a second end of the module. In the preferred arrangement, there is minimal thermal contact between the module and the surrounding spring guide tube.

The foregoing and other advantages of the present invention will be more fully understood by reference to the accompanying figures and text which follows.

DETAILED DESCRIPTION OF THE PREFERRED EMBODIMENT

Figure 1:
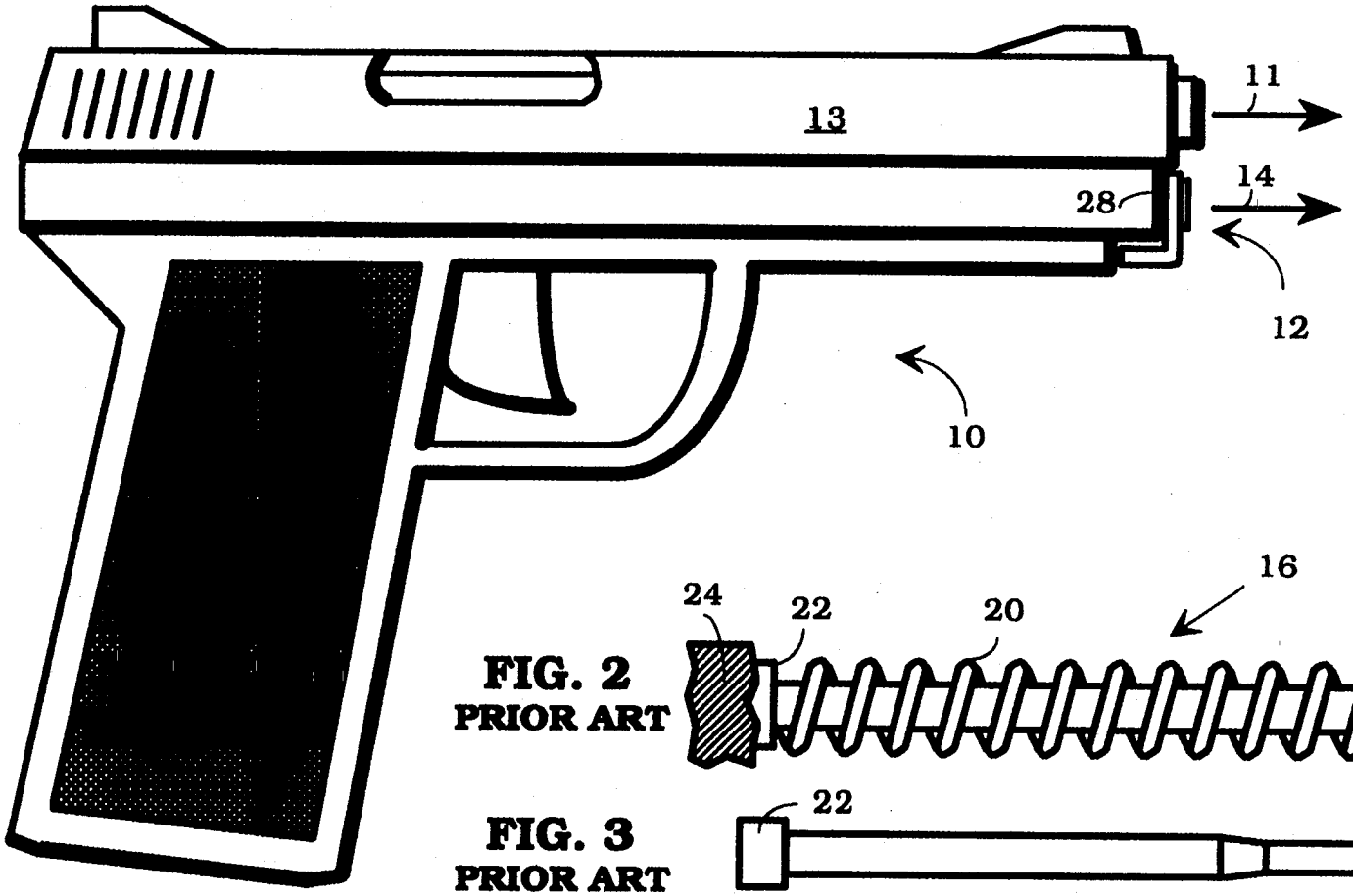
FIG. 1 is a simplified side view of a semi-automatic pistol containing a laser sighting assembly according to the present invention.

FIG. 1 is a simplified side view of semi-automatic pistol 10 adapted to fire projectiles in bore-sight direction 11, and in which has been mounted light beam aiming assembly 12 producing emergent light beam 14, according to a first embodiment of the present invention. Except for light beam aiming assembly 12, the other portions of weapon 10 are, generally, substantially conventional. The pistol depicted in FIG. 1 is in a non-firing state. Portion 13 of weapon 10 contains the breach and is referred to as the "slide". Slide 13 moves back and forth parallel to direction 11 when the weapon is fired.

Figure 2:
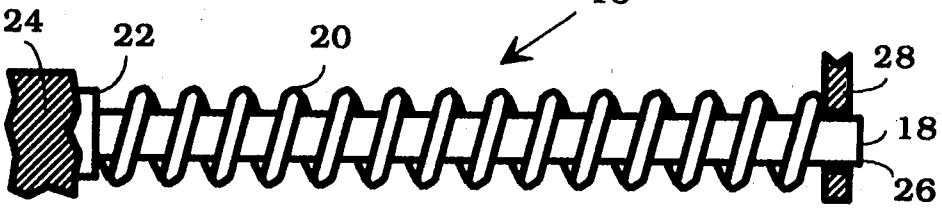
FIG. 2 PRIOR ART
FIG. 2 is a simplified partial cut-away side view of a conventional recoil spring and guide rod assembly according to the prior art.
Figure 3:
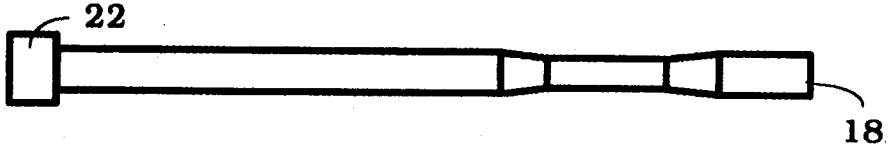
FIG. 3 PRIOR ART
FIGS. 3–4 are simplified side views of recoil spring guide rods according to the prior art, similar to that shown in FIG. 2, but without the recoil spring.
Figure 4:
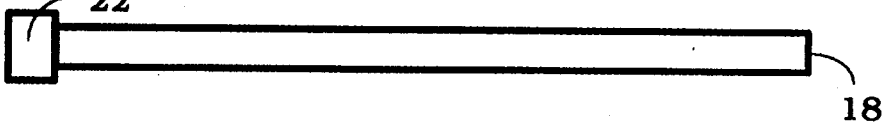
FIG. 4 PRIOR ART

FIG. 2 is a simplified partial cut-away side view of conventional recoil spring and guide rod assembly 16 according to the prior art. Assembly 16 would be contained within a pistol of the type shown in FIG. 1 if manufactured in the conventional manner without the light beam aiming assembly of the present invention. Assembly 16 comprises guide rod or tube 18 and spring 20. FIGS. 3–4 show prior an guide rods or tubes of various types with spring 20 removed, as would be seen when guide rod or tube 18 is removed from the weapon.

Figures 5, 6, 7, 8, 9:
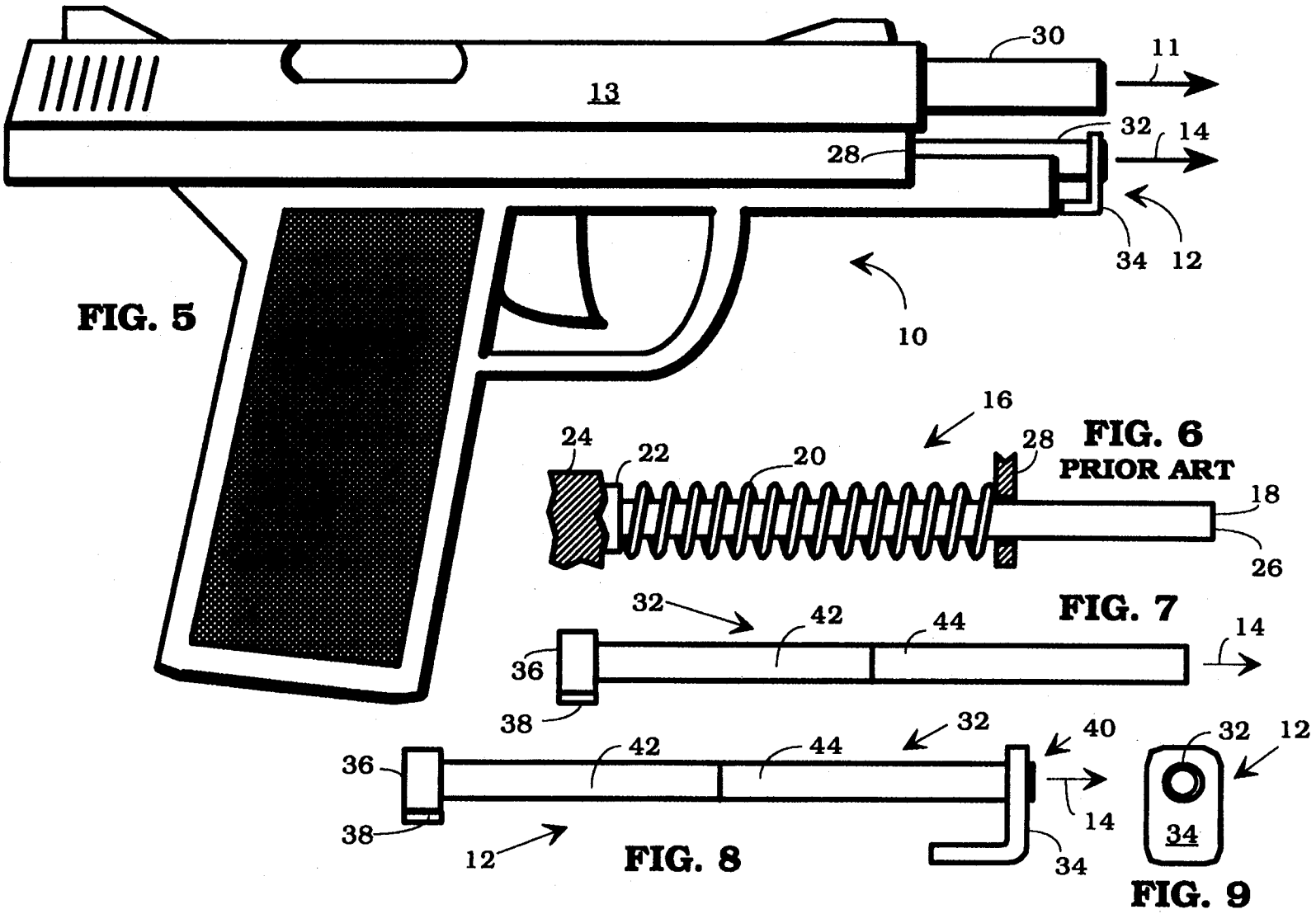
FIG. 6 PRIOR ART
FIG. 5 is a view similar to FIG. 1, but showing the location of the weapon slide when the weapon is firing and the breach has recoiled.
FIG. 6 is a view of the same prior art assembly as in FIG. 2 showing the compression of the recoil spring when the weapon in which it is contained is in the state depicted in FIG. 5.
FIG. 7 is a simplified side view of a recoil spring guide tube having therein a laser beam generation means, according to a first embodiment of the present invention.
FIG. 8 is a view of the tube of FIG. 7 according to the present invention, but with a rotational lever attached to the forward end.
FIG. 9 is a right side (end) view of the tube and lever of FIG. 8.

Guide rod or tube 18 has first end 22 which is generally fixed in relationship to portion 24 of the frame of gun 10, and second end 26 which has thereon movable portion 28 of gun 10. Movable portion 28 is generally coupled to slide 13 so that when the weapon fires and slide 13 recoils, portion 28 moves to the left along guide rod 18. FIG. 5 is a view similar to FIG. 1, but showing the location of weapon slide 13 and portion 28 when weapon 10 is firing and slide 13 has recoiled to expose barrel 30 and guide rod 32. FIG. 6 is a view of the same prior art assembly 16 as in FIG. 2 showing the compression of recoil spring 20 when the weapon in which it is contained is in the state depicted in FIG. 5.

FIG. 7 is a simplified side view of assembly 12 according to the present invention. Assembly 12 comprises guide tube 32 of substantially the same exterior dimensions as guide rod or tube 18. The laser beam generation means of the present invention is preferably entirely housed within tube 32. FIG. 8 is a view of the tube of FIG. 7 according to the present invention, but with rotational lever 34 attached to the forward end, and FIG. 9 is a right side (end) view of the tube and lever of FIG. 8.

In a preferred embodiment, tube 32 has end portion 36 similar in exterior dimensions and shape to end portion 22 of guide rod 18. Key 38 is optionally provided to prevent end 36 from rotating when tube 32 is assembled to gun frame portion 24, in place of guide rod 18. Tube 32 has end 40 to which lever 34 is conveniently attached.

Tube 32 has at least two portions 42, 44 which may be moved relative to each other. Portion 42 is coupled to substantially fixed end 36 (held by gun frame portion 24) and portion 44 to lever 34. When tube 32 is assembled in gun 10, recoil spring 20 surrounds tube 32 and slide portion 28 moves along tube 32 compressing spring 20, in the same manner as for assembly 16 in FIG. 6. The mechanical action of recoil spring 20 and the spring guiding function of tube 32 are conventional and when placed in gun 10, assembly 12 performs the same mechanical function as does spring and guide rod assembly 16. However, assembly 12 of the present invention performs the additional function of providing light beam 14 aligned to weapon boresight 11. As will be presently explained, lever 34 allows portion 44 of tube 32 to be moved relative to portion 42, so as to turn light beam 14 on and off. While lever 34 is shown as having a generally rectangular or rounded rectangular shape when viewed end-on (e.g., see FIG. 9) this is merely for convenience of explanation, and lever 34 may have any convenient shape and be attached to tube 32 by any convenient means. Lever 34 can be removable to facilitate disassembly of weapon 10, but this is not essential since tube 32 conveniently breaks into two portions 42, 44.

Figure 10:
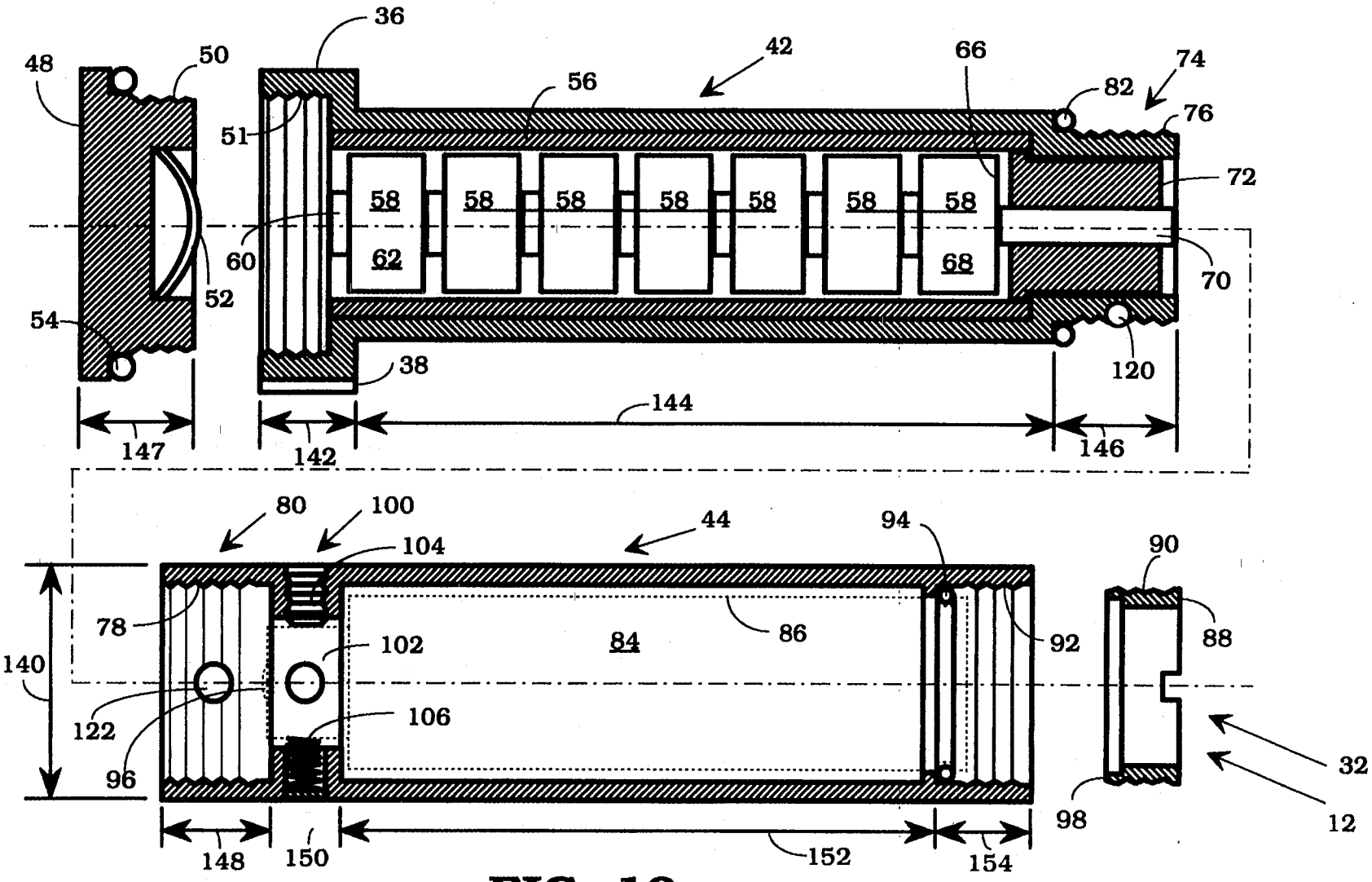
FIG. 10 is an exploded cross-sectional side and partial cut-away view of the tube of FIG. 7, showing interior details.

FIG. 10 is an exploded cross-sectional side and partial cut-away view of tube 32 of assembly 12 of FIGS. 7–9, according to the present invention and showing interior details. Lever 34 has been omitted for clarity. End region 36 of tube portion 42 comprises removable end cap 48. End cap 48 desirably engages end region 36 by means of threads 50, 51. End cap 48 comprises electrically conductive spring 52. End cap 48, end region 36 and tube portion 42 are desirably of metal, but any electrically conductive combination may be used. Any metals suitable for use in weapons is suitable.

Figure 13:
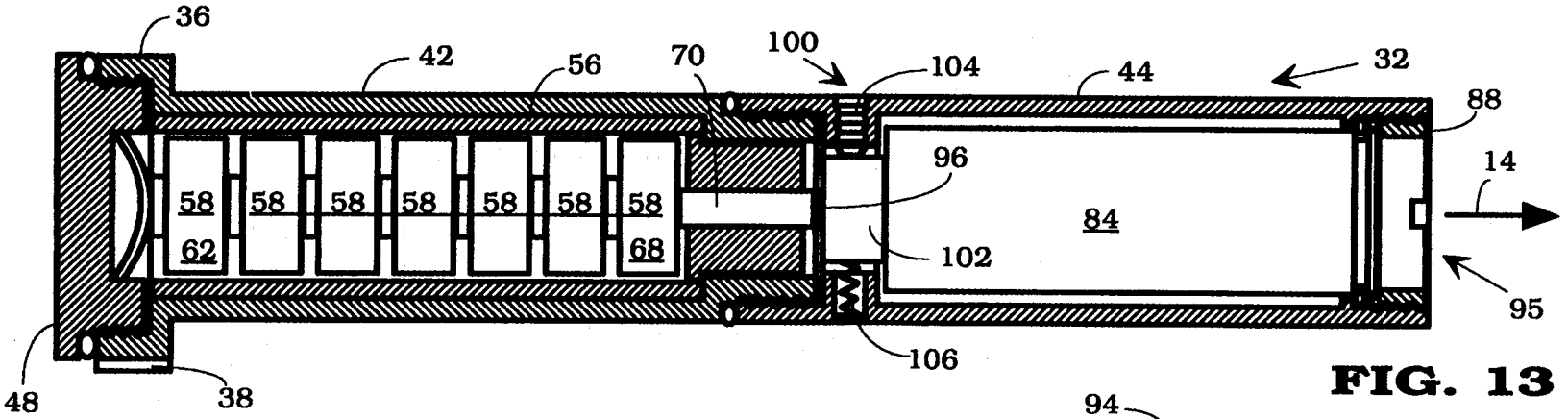
FIG. 13 is an assembled cross-sectional side and partial cut-away view of the tube of FIG. 10.

In the preferred embodiment, the mating portions of end cap 48 and end region 36 and the groove for O-ring 54 are configured so that when threads 50, 51 are fully engaged, O-ring 54 is captured and substantially surrounded by metal (see FIG. 13). Thus, in additional to providing environmental sealing, O-ring 54 acts as a resilient member which is compressed when cap 48 and end region 36 are engaged. This provides substantial friction to prevent cap 48 from moving when gun 10 is fired and to assist in absorbing the large mechanical shock received by assembly 12 receives when weapon 10 is fired. O-ring 82 is captured in a similar manner when tube portions 42, 44 are engaged. Inclusion of resilient and friction providing closure means is a particular feature of the present invention.

Portion 42 of tube 32 is hollow and contains insulating sleeve or lining 56. Contained within insulating sleeve or lining 56 are one or more batteries 58. While seven batteries 58 are illustrated in FIG. 10, this is merely for convenience of explanation, and those of skill in the art will understand that one or more batteries may be used, the particular number being chosen by the user depending upon the electrical requirements of the particular light source being employed. Thus, for the purposes of the present invention, any number of batteries may be included within portion 42, depending on the electrical demands of the light source being employed and the available space within portion 42. In the example of FIG. 10, the individual batteries are of the single button-cell variety and are arranged electrically in series. Type 393 silver oxide type batteries manufactured by the Everready Company of St. Louis, Mo. are examples of suitable batteries. They are available with dimensions that will fit within recoil spring guide tubes which fit in one or more modem day automatic pistols. However, other commonly available batteries may be employed depending upon the particular design requirements which must be satisfied (e.g., size, energy storage capacity, voltage, current, discharge rate, etc.).

When cap 48 is assembled to end region 36, spring 52 contacts pole 60 of out-board battery 62. Opposite pole 66 of in-board battery 68 contacts lead 70 held in place by insulating bushing 72 located within region 74 of tube portion 42. Lead 70 is typically of copper and insulating bushing 72 is conveniently of machinable or moldable plastic. Delrin TM is an examples of a suitable, well known and widely available Nylon TM type plastic material. Other well known plastic materials may also be used.

Region 74 of tube portion 42 desirably has threads 76 which mate with threads 78 in region 80 of tube portion 44. As was previously explained, O-ring 82 is provided not only for environmental protection, but, more importantly, to increase the resistance of assembly 12 to the shock associated with firing weapon 10. In the preferred embodiment, O-ring 82 acts as a resilient cushion that is captured and compressed when portions 42 and 44 are assembled. It provides friction to prevent undesired relative motion of portions 42, 44 and absorb shock.

Figure 11:
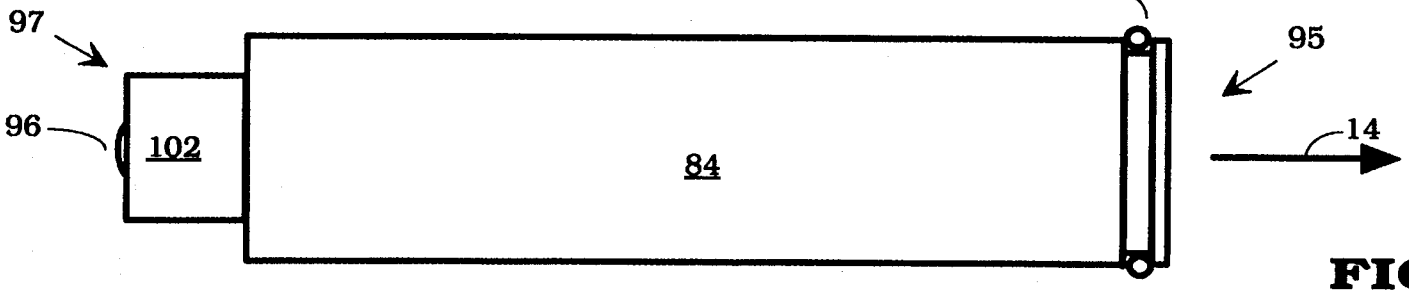
FIG. 11 is a simplified side view and FIG. 12 is a simplified cross-sectional and partial cut-away view, of a light beam generation module according to the present invention.
Figure 12:
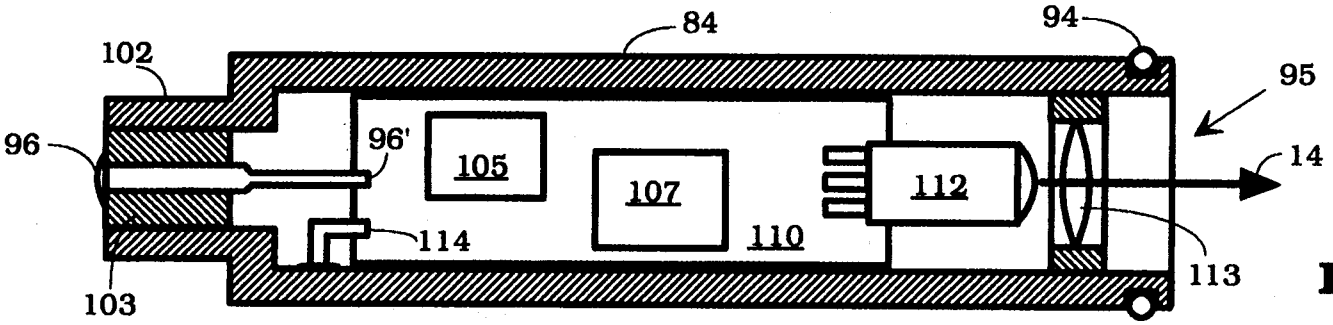

Portion 44 of tube 32 is hollow and houses light beam generating module 84 shown in further detail in FIGS. 11–12. Light beam generating module 84 is indicated in FIG. 10 by dashed outline 86 so that other details of the construction of portion 44 which would be obscured by module 84 may be seen. Module 84 is inserted into portion 44 from the right end in FIG. 10 and held in place by, for example, threaded retaining ting 88. Retaining ring 88 has threads 90 which mate with threads 92 of portion 44.

Referring now also to FIG. 11, module 84 has near end 95, O-ring 94 and near end 97, electrical contact 96. When module 84 is inserted into portion 44 and retaining ring 88 mates with portion 44, annular portion 98 of ring 88 presses against O-ring 94 to clamp module 84 within portion 44. Retaining ring 88 desirably does not touch module 84 nor does module 84 touch portion 44. Rather, module 84 is suspended within portion 84 by means of O-ring 94. In this manner, module 84 is centrally located within portion 44 and held firmly but not rigidly. The longitudinal axis of module 84 may be tilted slightly one way or another with respect to the longitudinal axis of portion 44 of tube 32. This is permitted because of the resilient nature of O-ring 94 and the manner in which it is captured between module 84, tube portion 44 and retaining ring 88. It is highly desirable to be able to tilt the longitudinal axis of module 84 so as to be able to align light beam 14 with boresight 11. In addition to allowing module 84 to be tilted, the O-ring support of end 95 aids in cushioning module 84 against the shock of gun 10 being fired. While use of O-ring 94 is an especially convenient means of providing a serf-locating but adjustable and resilient mounting for module 84, other means of grasping module 84 firmly by not rigidly may be used. What is important is the module 84 be retained in a stable position within tube 32 and be slightly tiltable so that alignment of light beam 14 may be aligned to boresight 11.

Tube Portion 44 has adjacent to end region 80, alignment adjustment means 100 which bears against portion 102 of module 84. Alignment adjustment means 100 conveniently comprises opposed set screws 104 and springs 106, as for example, a pair of each oriented at fight angles. Set screws 104 and springs 106 bear against region 102 of module 84. By turning set screws 104 by varying amounts, the longitudinal axis of module 84 may be tilted relative to the longitudinal axis of tube 32 so that light beam 14 becomes coaxial with the longitudinal axis of tube 32 or any other vector, e.g., boresight direction 11 (see FIG. 1). The ability to adjust the alignment of module 84 is important, since virtually all laser diodes (which are preferred as light sources) have a certain inherent amount of misalignment with respect to their housings and usually exhibit astigmatism. Astigmatism manifests itself in the form of the light beam 14 not being emitted from module 84 in a direction coincident with the axis of module 84.

In order to have a highly accurate light beam sight, individual adjustment of the trajectory of light beam 14 is needed. Alignment means 100 makes this possible. In general, at a least three point support is effective for alignment means 100. Two pairs of opposed springs and set screws, provide four point support which is more easily adjusted since, by arranging the screw-spring pairs to be orthogonal, the adjustments are independent. Once light beam 14 emitted from assembly 12 has been aligned to the desired direction, set screws 104 are conveniently locked in place (e.g., by a small drop of glue or paint) and no further adjustment is needed. Module 84 conveniently has an electrically conductive outer casing, as for example, metal.

An additional feature of the above-described means of suspending module 84 within tube portion 44, is that there is, at most, only a small area of thermally conductive contact between module 84 and tube 32. Conductive thermal contact from portion 44 to module 84 is through O-ring 95 and alignment means 100. O-ring 95 presents a narrow line contact through what is generally a poor thermal conductor. Alignment means 100 provides substantially point contact via, for example, set screws 104 and springs 106. Contact by screws 104 and springs 106 sufficient for electrical continuity between tube portion 44 and module 84, but provides little area for significant heat conduction between the two. Thus, module 84 is, conductively, thermally isolated from tube 32.

FIGS. 11–12, show further details of modules 84. FIG. 11 is a simplified side view and FIG. 12 is a simplified cross-sectional and partial cut-away view, of light beam generation module 84 according to the present invention. Module 84 comprises, conveniently, electrical circuit 110 for actuating light source 112, e.g., an LED or laser diode, and lens 113 for focusing light beam 14. Laser diodes 112 is desirably mechanically, thermally and electrically coupled to case 85 of module 84 by metal bushing 109. Circuit 110 draws energy from batteries 58 by means of first lead 96–96', and second lead 114 or bushing 109. First lead 96–96' conveniently has end 96 exposed on the axis of module 84 opposite emergent fight beam 14. Lead 96–96' is supported by insulated bushing 103. Second lead 114 and bushing 109 are conveniently electrically and mechanically coupled to conductive case 116 of module 84.

Electrical circuit 110 comprises suitable transistors or and/or integrated circuits (indicated generally by blocks 105, 107) which regulate the output from laser diode 112. Circuits for maintaining an approximately constant laser diode current and/or light output over a substantial range of battery voltage are well known in the art. For maximum battery life, it is desirable to utilize a regulating circuit which energizes laser diode 112 by means of pulses rather than continuously, but either arrangement is useful. The particular regulating circuit to be used depends upon the laser diode chosen by the designer, the number of batteries available and the voltage range over which the laser diode is required to function. Manufacturers of laser diodes and batteries provide information on the desirable operating ranges of their products which designers routinely use to select a regulator matched to their particular application. Those of skill in the an will understand how to provide a regulating circuit depending upon their choice of laser diode and batteries, without undue experimentation.

In the preferred embodiment, diode 112 is energized, moving lead 96 in portion 44 into contact with lead 70 in portion 42. This is conveniently accomplished by varying the amount by which threads 76, 78 are engaged. Twisting portion 44 relative to portion 42 causes leads 96 and 70 to make or break contact. Thus, leads 96, 70 in combination with threaded portions 74, 80 act as an electrical switch for turning laser assembly 12 on and off. Light beam 14 is turned on and off by moving portion 44 relative to portion 42. In the example shown, rotary motion of portion 44 relative to portion 42 causes leads 96, 70 to approach or retract from each other. While this arrangement is preferred, it is not essential, and as those of skill in the an will understand based on the description herein, any means of moving portion 44 relative to portion 42 (or vice-versa) can be used to make or break a contact between leads 96, 70 and thus, control the electrical circuit. For example, threats 74, 78 may be omitted and portions 44, 42 slide together and apart. However, the use of screw threads for engaging and disengaging leads 69, 70 is preferred.

During assembly of tube 32, portions 44 and 42 are screwed together until only about one-quarter turn is needed to make or break the contact between leads 96, 70. Lever 34 is fixed to tube 32 (e.g., by a set screw) so that rotating lever 34 around the axis of tube 32 by approximately ninety degrees brings leads 96, 70 into contact (or apart) and causes light beam 14 to be activated (or de-activated). In order to have positive "on" and "off" positions, captured ball 120 is desirably provided in threaded region 74 and matching detents 122 are provided about ninety degrees apart in threaded region 80 of portion 42, or vice-versa. Plastic (e.g., Nylon TM) may be used for ball 120 so that some resilience is built-in. FIG. 13 is an assembled cross-sectional side and partial cut-away view of the tube of FIG. 10. Those of skill in the art will understand, based on the description herein, how to form tube 32 and bushing 72 without undue experimentation.

Figures 14, 15, 16, 17:
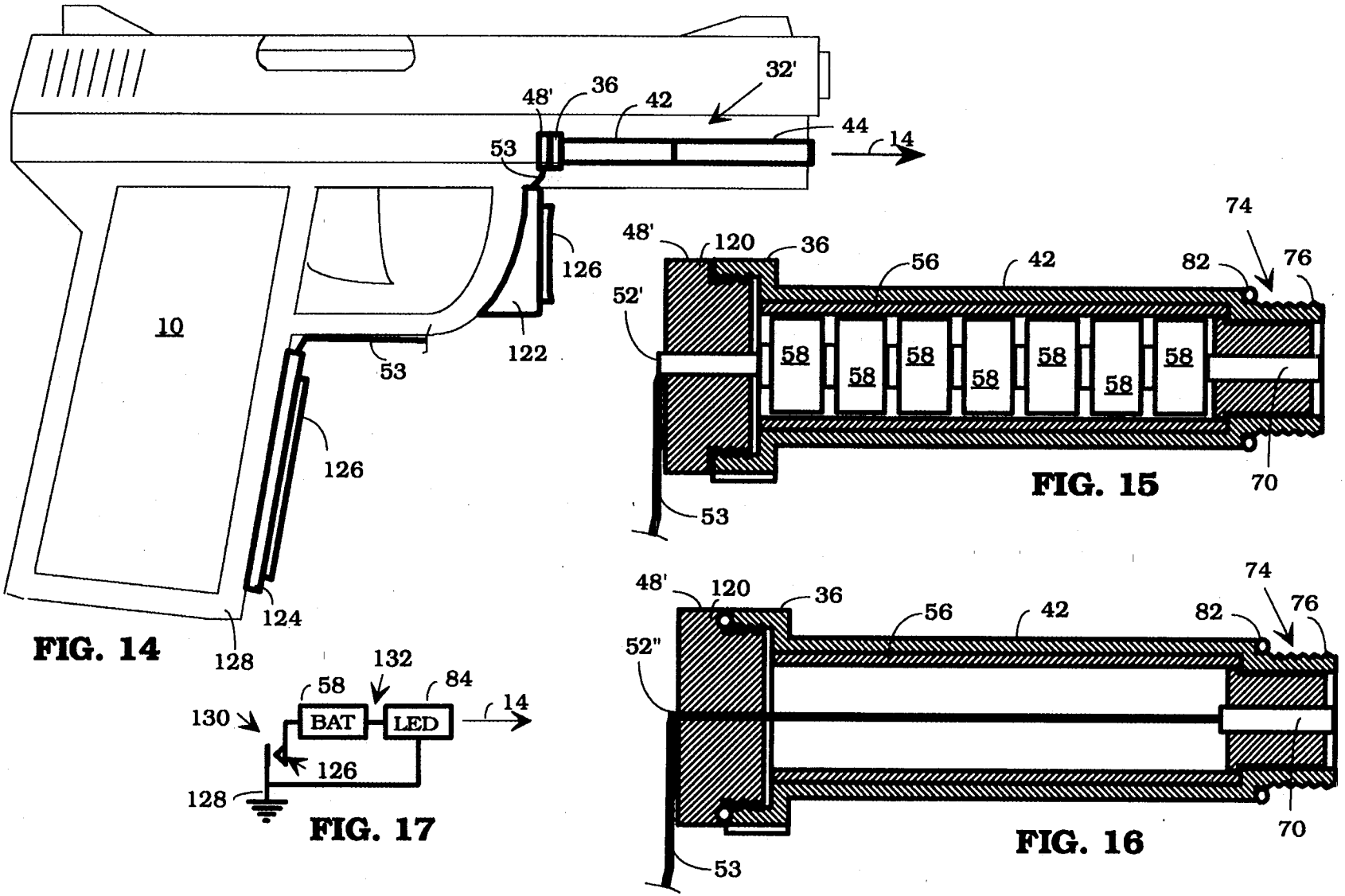
FIG. 14 is simplified phantom side view of pistol 10 similar to FIG. 1, but with a modified recoil spring guide tube according to a further embodiment of the present invention, installed therein.
FIGS. 15–16 are partial cut-away and cross-sectional side views of a portion of the recoil spring guide tube of FIG. 14, showing further detail.
FIG. 17 is a simplified electrical schematic of the arrangement of FIGS. 14–16.

FIG. 14 is simplified phantom side view of pistol 10 similar to FIG. 1, but with modified recoil spring guide tube 32 according to a further embodiment of the present invention, installed therein. The recoil spring has been omitted for clarity. FIGS. 15–16 are partial cut-away and cross-sectional side views of portion 42 of the recoil spring guide tube of FIG. 14, showing further detail, and FIG. 17 is a simplified electrical schematic of the arrangement of FIGS. 14–16.

Portions 42 and 44 of tube 32' are assembled such that leads 69 and 70 are in electrical contact. End portion 48' of tube 32' is modified to provide insulated bushing 120 through which extends conductor 52' (FIG. 15) or 52'' (FIG. 16). Conductors 52', 52'' are coupled to insulated lead 53 which extends from tube 32' to switch 122 or 124 mounted to frame 128 of gun 10. Switch 122 is conveniently mounted to the forward portion of the trigger guard and switch 124 is conveniently mounted to the forward edge of the butt. Either arrangement is useful and other locations on the gun, e.g., along the side of the weapon, may also be used as a location for switch 122, 124. Switches 122, 124 are activated by depressing button or pad 126 which causes switch 130 to close (see FIG. 17), thereby coupling the electrical signal through the frame of the gun back to laser module 84. This is possible because most pistols utilize metal frames and module 84 conveniently has conductive housing 86 to which one lead of circuit 110 is coupled, e.g., lead 114 or bushing 109, as shown for example in FIG. 12. In those instances where pistol 10 lacks a metal frame, an additional wire is used to provide continuity back to conductive spring guide tube 32.

FIG. 15 illustrates an embodiment in which batteries 58 are provided in tube portion 42 in substantially the same manner as already described, but where the on/off switching function for energizing laser diode 112 is accomplished by switch 122 or 124. FIG. 16 illustrates a further embodiment in which batteries 58 are omitted from tube 32 and placed in switch 122 or 124 or elsewhere in the weapon. In this embodiment, switch 130 is at location 132 in the circuit of FIG. 17. Either arrangement is satisfactory. However, having batteries, laser diode and switch 69, 70 within tube 32, as is shown for example in FIG. 13, avoids external switches 122, 124 and keeps the outer profile of the weapon especially clean and free from protrusions. This is desirable.

The following is an example of the construction of a fully self-contained internally mountable laser sighting assembly according to the present invention. Referring now to FIG. 10, a laser beam generation apparatus is constructed according to the present invention. Tube 32 has outer diameter 140 of about 0.34 inches, i.e., to fit a commonly available automatic pistol. Portion 36 has length 142 of about 0.165 inches, portion 42 has central length 144 of about 1.325 inches, and externally threaded length 146 of about 0.4 inches, including the space for O-ring 82. End cap 48 has length 147 of about 0.15 inches. Tube portion 44 has internally threaded length 148 of about 0.425 inches, including small clearance regions at the beginning and end of the threads, adjustment region length 150 of about 0.125 inches, central chamber length 152 of about 1.475 inches and internally threaded length 154 of about 0.20. Retention ring 88 is sized to fit within threaded portion 92 of tube portion 44 and engage O-ring 94 to flexibly retain module 84, as previously described. Module 84 had an outer diameter less than 0.31 inches so as to fit within the bore of that size in the central part of tube portion 44. Lyte Optronics of Santa Monica, Calif. supplies a laser module of a size which will fit within a tube of 0.31 inch bore and such laser module is suitable for use as laser module 84 of the present invention. Insulated spacer 72 is conveniently of Delrin TM . Tube 32 and portions 42, 44, 48 and 88 are conveniently fabricated from metal. Brass is suitable where fine threads and easy machinability are desired and iron alloys are more suitable for those portions which encounter heavy mechanical abrasion, as for example, from caused by recoil spring 20. Those of skill in the art will understand based on the description herein how to choose appropriate materials for constructing tube 32 and its various parts. Silver oxide batteries were used.

For proper operation, it is important to adjust the alignment of module 84 within tube portion 44 of tube 32 to provide light beam 14 in the correct direction. This is because laser diodes exhibit various optical anomalies which cause the beam emitted thereby to differ from the geometric axis of the laser diode package or housing. Thus, provision is made using alignment means 100 for aligning module 84 to provide beam 14 exiting in the desired direction, i.e., parallel to boresight 11. This is accomplished by placing tube portion 44 or assembled tube 32 in an alignment fixture having a known relationship to boresight 11 and adjusting screws 104 until beam 14 falls at the correct location relative to the boresight.

However, it is preferable to install tube 32 within weapon 10 and, with slide 13 retracted or removed, adjust screws 104 (or other adjustment means 100) until beam 14 is aligned with boresight 11, which alignment can be determined directly. Alignment of module 84 in-situ compensates for any tolerance variations and/or misalignment of the gun components, and misalignment and/or variation (e.g., astigmatism) of the laser module components. The ability to adjust the aiming point of beam 14 is an important advantage of the present invention, for several reasons. First, not all recoil spring guide tubes are installed in weapons parallel to the barrel. Thus, if there is no means of adjusting beam 14 it will not coincide with the boresight. Second, actual bullet trajectories vary with bullet shape, size and weight, and with the powder load. Thus, even when the barrel is aligned with the guide tube, a need exists to be able to move the aiming point relative to the boresight to compensate for differences in bullet trajectory due to differences in ammunition. Third, it is desirable to be able to set the aiming point for different distances, i.e., to compensate for different amounts of drop for different ranges. Thus, the laser sight maybe set to show the bullet impact point at a range of 25 yards, or 50 yards, or whatever distance the shooter desires. The present arrangement allows such adjustment. Screws 104 are desirably of a high friction type so that they do not move when the gun is fired. If it is desired to fix screws 104 in a given position this is easily accomplished with a drop of cement or paint or the like.

The ability to mode module 84 to be adjusted in flit relative to the axis of tube 32 and/or boresight 11 is important. Module 84 is resiliently mounted in tube portion 44 by O-ring 94, retention ting 88, and adjustment means 100. This is an important aspects of the present invention, since it permits the deficiencies of typical laser diodes or other light sources (and variations in the gun) to be largely compensated before or after installation of tube 32 and assembly 12 in gun 10.

It is apparent based on the above description that the present invention provides a laser sight beam generation module and laser sighted gun in which, according to the preferred embodiment, the laser generation module, batteries and on/off switch are entirely housed within the spring guide tube of the weapon, so that an externally mounted sight is not required. This is a great advantage.

Further, the present invention permits the laser module to be properly aligned to compensate for astigmatism and other optical imperfections common in laser diodes, and for machining tolerances in the weapon, and for variations in bullet and powder load, so that the accuracy of the laser sight is not substantially degraded by such. In addition, the invented arrangement requires very little if any modification of the gun. It is easily adaptable to a large variety of weapons using recoil spring guide rods or tubes. These are desirable features.

In addition, laser module 84 is substantially thermally isolated so far as conductive head transfer from weapon 10 through tube 32 is concerned., This is because module 84 is suspended within tube 32 by small area (e.g. line) contact to O-ring 94 and small area (e.g., point) contact to alignment means 100. There is no large area thermal contact between module 84 and tube 32 and/or weapon 10. The heat generated within diode 112 is small compared to the heat generated by firing weapon 10. For example, shooting 50–100 rounds in a short period of time can raise the barrel temperature to 300°–400° F. Without the thermal isolation provided by the invented arrangement, heat from barrel 30 would be rapidly conducted to diode 112, thereby degrading its performance. At about 140° F., most laser diodes stop emitting. Thus, providing conductive thermal isolation to aid in avoiding significant heat coupling to diode 112 is an important feature of the present invention.

Having thus described the invention, those of skill in the art will appreciate that numerous modifications can be made from the arrangements illustrated for purposes of explanation without departing from the spirit of the present invention. For example, while leads 69, 70 are conveniently brought into contact by use of screw threads, this is not essential and any means for making and breaking the contact may be used. Accordingly, it is intended to include these and such other variations as will occur to those of skill in the art based on the description herein, in the claims that follow.

What is claimed is:

1. A light beam sightable weapon, comprising:

a hollow tube smaller than and mounted within the weapon and having a first portion and a second portion, wherein the first portion is coupled to the weapon and the second portion moves with respect to the first portion;

light beam generation means mounted within the tube for projecting a light beam out of the tube;

energy storage means coupled to the light beam generation means for energizing the light beam generation means; and switch means electrically interposed between the energy storage means and the light beam generation means for turning the light beam on and off when actuated by movement of the second portion of the tube relative to the first portion of the tube.

2. The light beam sightable weapon of claim 1 wherein the light beam is projected out of an end of the tube.

3. The light beam sightable weapon of claim 1 wherein the first and second portions of the tube are coaxially aligned and the second portion rotates with respect to the first portion around their common axis.

4. The light beam sightable weapon of claim 1 wherein the switch means comprises a first contact in the first portion and a second contact in the second portion, and wherein rotation of the second portion relative to the first portion axially displaces one of the first or second contacts toward or away from the other, so as to make or break an electrical circuit coupling the energy storage means and the light beam generation means.

5. The light beam sightable weapon of claim 1 wherein the first portion comprises a battery compartment for receiving multiple battery cells and the second portion comprises an electronics compartment for receiving the light beam generation means, and wherein the first and second portions are joined by a longitudinally oriented thread means.

6. The light beam sightable weapon of claim 1 wherein the light beam generation means is mounted within the second portion.

7. The light beam sightable weapon of claim 1 wherein the light beam generation means is internal to the second portion and coupled thereto by a flexible mounting proximate a first end and a transversely adjustable mounting proximate a second end of the light beam generation means.

8. The light beam sightable weapon of claim 7 wherein the flexible mounting means comprises a circular ring captured between the light beam generation means and an interior wall of the tube.

9. A light beam sightable weapon, comprising:

a hollow tube mounted within the weapon and having a first portion and a second portion, wherein the first portion is coupled to the weapon and the second portion moves with respect to the first portion;

light beam generation means mounted within the tube for projecting a light beam out of the tube;

energy storage means coupled to the light beam generation means for energizing the light beam generation means;

switch means electrically interposed between the energy storage means and the light beam generation means for turning the light beam on and off when actuated by movement of the second portion of the tube relative to the first portion of the tube, wherein the tube comprises a recoil spring guide tube.

10. A light beam generation assembly for a weapon, comprising:

a hollow tube having first and second detachable portions, said hollow tube being adapted to mount within the weapon;

one or more batteries mounted in the first portion of the hollow tube;

a laser diode mounted in the second portion of the hollow tube; and switch means located within the hollow tube between the batteries and the laser diode, wherein the switch means is actuated by relative motion of the first and second portions of the hollow tube.

11. The assembly of claim 10 further comprising threads whereby the first and second portions screw together and wherein the relative motion is produced by varying the engagement of the threads.

12. A laser beam sightable weapon, comprising:

a hollow tube for guiding a recoil spring;

a light beam generation module for providing a light beam for sighting the weapon; and a resilient mounting means for holding the light beam generation module, wherein the module is resiliently mounted within the tube and conductively thermally isolated therefrom.

13. The weapon of claim 12 further comprising alignment means for tilting a longitudinal axis of the module relative to a longitudinal axis of the hollow tube.

14. A laser beam sightable weapon, comprising:

a hollow tube mounted within the weapon and forming a recoil spring guide for the weapon;

a light beam generation module mounted within the tube; and means for suspending the module within the tube and varying orientation of a longitudinal axis of the module relative to orientation of a longitudinal axis of the tube.

15. The weapon of claim 14 wherein the suspending means holds the module within the tube so that the module is substantially conductively thermally isolating from the tube.

16. A laser light beam generation assembly, comprising:

a hollow tube forming a recoil spring guide for a weapon;

a light beam generation module; and means for suspending the module within the tube and varying orientation of a longitudinal axis of the module relative to orientation of a longitudinal axis of the tube, wherein said means includes a poorly thermally conductive circumferential ring enclosing a portion of the module.

17. The assembly of claim 16 wherein the suspending means suspends the module within the tube without significant thermally conductive contact.

18. The assembly of claim 16 wherein the means for varying orientation of a longitudinal axis of the module comprises adjustment means making contact with only a part of a circumference of the module.

19. The assembly of claim 16 wherein the means for varying orientation comprises screw and spring adjustment means bearing on the module near a first end and the circumferential ring bearing on the module near a second, opposed, end the module.

20. The assembly of claim 16 wherein the tube comprises first and second portions with electrical switching means therebetween for turning the light beam on and off.

* * * * *